US010753070B2

(12) United States Patent
Han et al.

(10) Patent No.: US 10,753,070 B2
(45) Date of Patent: Aug. 25, 2020

(54) WELL CURB DEVICE AND METHOD FOR CONTROLLING THE SAME

(71) Applicant: BOE Technology Group Co., Ltd., Beijing (CN)

(72) Inventors: Xuelin Han, Beijing (CN); Xin Wang, Beijing (CN); Fan Yang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 231 days.

(21) Appl. No.: 16/038,400

(22) Filed: Jul. 18, 2018

(65) Prior Publication Data

US 2019/0203447 A1 Jul. 4, 2019

(30) Foreign Application Priority Data

Jan. 2, 2018 (CN) ..... 2018 1 0003175

(51) Int. Cl.

| | |
|---|---|
| ***E03F 5/00*** | (2006.01) |
| ***E03B 5/06*** | (2006.01) |
| ***G08B 21/02*** | (2006.01) |
| ***G08B 5/36*** | (2006.01) |
| ***E03F 5/04*** | (2006.01) |

(52) U.S. Cl.

CPC ..... *E03B 5/06* (2013.01); *E03F 5/04* (2013.01); *G08B 5/36* (2013.01); *G08B 21/02* (2013.01)

(58) Field of Classification Search

CPC ... E03B 5/06; G08B 5/36; G08B 21/02; E03F 5/04

USPC ..... 404/2–4, 25, 26, 72; 52/19, 20

See application file for complete search history.

(56) References Cited

U.S. PATENT DOCUMENTS

| | | | | |
|---|---|---|---|---|
| 7,889,079 | B2 * | 2/2011 | Albahri | G08B 13/149 116/12 |
| 8,522,487 | B2 * | 9/2013 | Whiting | E05B 47/02 52/19 |
| 10,280,587 | B2 * | 5/2019 | Nachyla | E02D 29/1481 |
| 2011/0148647 | A1 * | 6/2011 | Miller, II | E02D 29/1481 340/686.1 |

* cited by examiner

*Primary Examiner* — Raymond W Addie

(74) *Attorney, Agent, or Firm* — Fay Sharpe LLP

(57) ABSTRACT

A well curb device and a method for controlling the same. The well curb device includes: a well curb, a well cover sensor, a light sensing component and an audible alertor. The well curb includes a placing portion for placing a well cover. The well cover sensor is disposed on the well curb, and is configured to detect whether a well cover is placed in the placing portion. The light sensing component is configured to trigger the audible alertor to issue an audio alarm of a specified decibel, when detecting that the light intensity around the well curb is greater than the specified value, thereby improving the safety of the well curb device.

20 Claims, 2 Drawing Sheets

WELL CURB DEVICE AND METHOD FOR CONTROLLING THE SAME

This application claims priority to Chinese Patent Application No. 201810003175.6, filed with the State Intellectual Property Office on Jan. 2, 2018 and titled "WELL CURB DEVICE AND METHOD FOR CONTROLLING THE SAME", the entire contents of which are incorporated herein by reference.

TECHNICAL FIELD

The present disclosure relates to a well curb device and a method for controlling the same.

BACKGROUND

A situation often occurs in life where a pedestrian falls into a well without a well cover, resulting in an injury to the pedestrian. Therefore, a well curb (a device disposed at a wellhead and capable of holding the well cover) that can guarantee walking safety of pedestrians is urgently required.

There is a kind of well curb device in the related art. The well curb device includes: a well curb, a placing portion for placing a well cover on the well curb, a light-emitting alarm component, and a sensing component for sensing whether the well cover is placed in the placing portion or not. Herein, when the sensing component senses that the well cover is not placed in the placing portion, the light-emitting alarm component can emit light to alert the pedestrian, so as to prevent the pedestrian from falling into the well without the well cover.

However, in the related art, it is hard for the pedestrian, in the case of bright light, to perceive the light emitted by the light-emitting alarm component of the well curb device. Therefore, there is still a danger that the pedestrian falls into the well without the well cover and then is injured, thus the safety of the well curb device is relatively low.

SUMMARY

There are provided in the embodiments of the present disclosure a well curb device and a method for controlling the same.

In a first aspect, there is provided a well curb device including: a well curb, a well cover sensor, a light sensing component and an audible alertor, where the well cover sensor, the light sensing component and the audible alertor are sequentially connected; the well curb comprises a placing portion for placing a well cover; the well cover sensor is disposed on the well curb, and is configured to detect whether the well cover is placed in the placing portion; the well cover sensor is configured to trigger the light sensing component to detect whether a light intensity around the well curb is greater than a specified value, when detecting that the well cover is not placed in the placing portion; and the light sensing component is configured to trigger the audible alertor to issue an audio alarm of a specified decibel, when detecting that the light intensity around the well curb is greater than the specified value.

Optionally, the well curb device comprises a light alertor connected with the light sensing component, wherein the light sensing component is configured to trigger the light alertor to issue a light alarm of a specified brightness, when detecting that the light intensity around the well cover is not greater than the specified value.

Optionally, the light sensing component is configured to trigger the audible alertor to issue an audio alarm, when detecting that the light intensity around the well cover is not greater than the specified value.

Optionally, the well curb device further comprises a liquid level sensing component connected with the light alertor and the audible alertor, where the liquid level sensing component is configured to detect whether a water level around the well curb is higher than a specified height; and when the water level around the well curb is higher than the specified height, the liquid level sensing component is configured to trigger the light alertor to issue a light alarm of a specified high brightness, and trigger the audible alertor to issue an audio alarm of a specified high decibel; the specified high brightness is greater than the specified brightness, and the specified high decibel is greater than the specified decibel.

Optionally, the liquid level sensing component comprises: a liquid level sensor and a comparator, the liquid level sensor is configured to acquire a height of water submerging the well curb device; and the comparator is configured to compare the height with the specified height, and determine that the water level around the well curb is higher than the specified height when the height is higher than the specified height.

Optionally, the well curb device further comprises a guard component disposed in the well curb; when detecting that the well covert is not placed in the placing portion, the well cover sensor triggers the guard component to form a blocking structure in a space enclosed by the well curb, so as to block an object from passing through the well curb.

Optionally, the guard component comprises an expansible fence.

Optionally, the well cover sensor comprises a pressure sensor.

Optionally, the well cover sensor further comprises a comparator, the pressure sensor is configured to acquire a pressure value applied to the placing portion; and the comparator is configured to compare the pressure value with a specified pressure value, and determine that the well cover is not placed in the placing portion when the pressure value is less than the specified pressure value.

Optionally, the well curb device further comprises an reminder component disposed in the well curb, wherein the well cover sensor is configured to trigger the reminder component to send reminder information to a specified device in a wired or wireless manner, when detecting that the well cover is not placed in the placing portion.

Optionally, the well curb device further comprises a human body sensor connected with the light sensing component and the audible alertor, wherein the human body sensor is configured to detect whether a human body is close to the well curb within a specified range of the well curb, the light sensing component is configured to trigger the human body sensor to detect whether a human body is close to the well curb within the specified range, when detecting that the light intensity around the well curb is greater than the specified value; and the human body sensor is configured to trigger the audible alertor to issue an audio alarm of the specified decibel, when detecting that a human body is close to the well curb in the specified range.

Optionally, the human body sensor is an infrared sensor.

Optionally, the well curb device further comprises a reset button connected with the well cover sensor, the light sensing component, the audible alertor, the light alertor and the guard component, wherein the reset button is configured to control ON/OFF of the well cover sensor, the light sensing component, the audible alertor, the light alertor and the guard component.

Optionally, the well curb device further comprises an energy source component connected with the well cover sensor, the light sensing component and the audible alertor.

Optionally, the specified brightness is positively correlated with the light intensity around the well cover.

In a second aspect, there is provided a control method of a well curb device for controlling the well curb device, where the well curb device comprises: a well curb, a well cover sensor, a light sensing component and an audible alertor, the well cover sensor, the light sensing component and the audible alertor are sequentially connected, the well curb comprises a placing portion for placing a well cover, and the well cover sensor is disposed on the well curb, and the method comprises the steps of:

detecting, by the well cover sensor, whether a well cover is placed in the placing portion;

detecting, by the light sensing component, whether the light intensity around the well curb is greater than a specified value, when the well cover is not placed in the placing portion; and issuing, by the audible alertor, an audio alarm of a specified decibel, when the light intensity around the well curb is greater than the specified value.

Optionally, the well curb device further comprises a light alertor connected with the light sensing component, and wherein the method further comprises the step of:

triggering, by the light sensor, the light alertor to issue a light alarm of a specified brightness, when detecting that the light intensity around the well cover is not greater than the specified value.

Optionally, the well curb device further comprises a liquid level sensing component connected with the light alertor and the audible alertor, and wherein the method further comprises the steps of:

detecting, by the liquid level sensing component, whether a water level around the well curb is higher than a specified height; and triggering, by the liquid level sensor, the light alertor to issue the light alarm of a specified high brightness, and trigger the audible alertor to issue the audio alarm of a specified high decibel, when the water level around the well curb is higher than the specified height; and a specified high brightness is greater than the specified brightness, and a specified high decibel is greater than the specified decibel.

Optionally, the well curb device further comprises a guard component disposed in the well curb, and wherein the method further comprises the step of: triggering, by the well cover sensor, the guard component to form a blocking structure in a space enclosed by the well curb, when detecting that the well cover is not placed in the placing portion, so as to block an object from passing through the well curb.

In a third aspect, there is provided a computer storage medium storing instructions; when the computer storage medium is running on a well curb device, the well curb device performs a method for controlling a well curb device, the well curb device includes a well curb, a well cover sensor, a light sensing component and an audible alertor; the well cover sensor, the light sensing component and the audible alertor are sequentially connected, the well curb includes a placing portion for placing a well cover; and the well cover sensor is disposed on the well curb, and wherein the method comprises the steps of:

detecting, by the well cover sensor, whether a well cover is placed in the placing portion;

detecting, by the light sensing component, whether a light intensity around the well curb is greater than a specified value, when the well cover is not placed in the placing portion; and issuing, by the audible alertor, an audio alarm of a specified decibel, when the light intensity around the well curb is greater than the specified value.

DETAILED DESCRIPTION

In order to make the principles and advantages of the present disclosure clearer, the embodiments of the present disclosure are described below with reference to the enclosed drawings.

Figure 1:
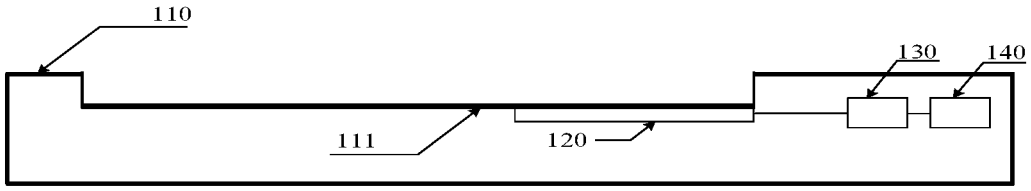
FIG. 1 is a schematic diagram of a structure of a well curb device provided in an embodiment of the present disclosure.

FIG. 1 is a schematic diagram of a structure of a well curb device illustrated by an embodiment of the present disclosure. The well curb device may include a well curb 110, a well cover sensor 120, a light sensing component 130 and an audible alertor 140.

As shown in FIG. 1, the well cover sensor 120, the light sensing component 130 and the audible alertor 140 are connected in sequence. The well curb 110 includes a placing portion 111 for placing a well cover. The placing portion 111 is used to hold and secure the well cover. A shape of the placing portion 111 can be set according to a shape of the well cover. The well cover sensor 120 is disposed on the well curb 110, and is used to detect whether a well cover is placed in the placing portion 111. Exemplarily, a groove can be provided on the placing portion 111, and the well cover sensor 120 can be disposed in the groove. When a well cover is placed on the placing portion 111, the well cover sensor 120 may be in contact with a bottom of the well cover.

When detecting that the well cover is not placed in the placing portion 111, the well cover sensor 120 can be used to trigger the light sensing component 130 to detect whether a light intensity around the well curb 110 is greater than a specified value, where "around the well curb 110" refers to a surrounding of a region where the well curb 110 is in contact with air.

When detecting that the light intensity around the well curb is greater than the specified value, the light sensing component 130 can be used to trigger the audible alertor 140 to issue an audio alarm of a specified decibel.

In summary, when the well cover is not placed in the placing portion and the light intensity around the well curb is greater than a specified value, the well curb device provided in the embodiments of the present disclosure can trigger an audible alertor to issue an audio alarm of a specified decibel. That is, even in the case of bright light, the well curb device can still alert the pedestrian by means of an audible alertor, so as to prevent the pedestrian from falling into a well without a well cover, thereby solving the problem of lower safety of the well curb device in the related art, and improving the safety of the well curb device.

Optionally, as an example, the well cover sensor 120 may include a pressure sensor and a comparator. The pressure sensor can be used to acquire a pressure value applied to the placing portion 111. The comparator can be used to compare the pressure value with a specified pressure value. When the well cover is placed on the placing portion 111, the specified pressure value can be smaller than the pressure value applied by the well cover to the placing portion 111. Exemplarily, the specified pressure value can be 90% of the pressure value applied by the well cover to the placing portion 111, when the well cover is placed in the placing portion 111. Both the pressure value and the specified pressure value acquired by the pressure sensor can be electrical signals. The comparator can determine whether the pressure value acquired by the pressure sensor is greater than the specified pressure value by comparing a magnitude of the two electrical signals. When the pressure value is smaller than the specified pressure value, the comparator can send a trigger signal to the light sensing component 130, so as to trigger the light sensing component 130 to detect whether the light intensity around the well curb 110 is greater than the specified value.

For example, the pressure sensor can be a piezoelectric pressure sensor, a diffusion silicon pressure sensor, a sapphire pressure sensor, or the like.

In addition, another well cover sensor 120 can include an obstacle sensor that can detect whether there is an obstacle (i.e., a well cover) in the placing portion 111 or not. When there is an obstacle in the placing portion 111, the obstacle sensor can send a trigger signal to the light sensing component 130, so as to trigger the light sensing component 130 to detect whether the light intensity around the well curb 110 is greater than the specified value.

The light sensing component 130 can include a light sensor and a comparator. The light sensor can be used to acquire a brightness value around the well curb 110. The comparator can be used to compare the brightness value with the specified brightness value. The specified brightness value can be an average brightness value of a position where the well curb is located during the daytime. The average brightness value can be updated every predetermined period, e.g., once every other week. Both the brightness value acquired by the light sensor and the specified brightness value can be electrical signals. The comparator can determine whether the brightness value acquired by the light sensor is greater than the specified brightness value by comparing a magnitude of the two electrical signals. When the brightness value is greater than the specified brightness value, the comparator can send a trigger signal to the audible alertor 140, so as to trigger the audible alertor 140 to issue an audio alarm.

When the well cover is not placed in the placing portion and the light intensity around the well curb is greater than the specified value, the well curb device provided in the embodiments of the present disclosure can trigger an audible alertor to issue an audio alarm. That is, even in the case of bright light, the well curb device can still alert the pedestrian by means of an audible alertor, so as to prevent the pedestrian from falling into a well without a well cover.

Figure 2:
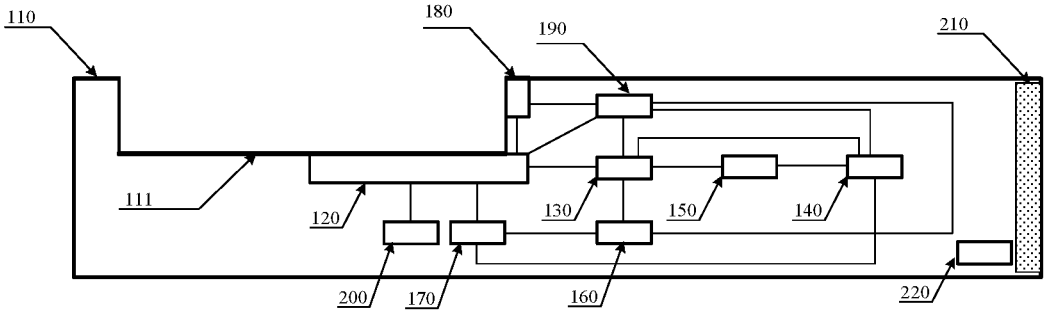
FIG. 2 is a schematic diagram of a structure of another well curb device provided in an embodiment of the present disclosure.

FIG. 2 is a schematic diagram of a structure of another well curb device provided in an embodiment of the present disclosure.

As shown in FIG. 2, the light sensing component 130 is connected with the audible alertor 140. When detecting that the light intensity around the well curb 110 is not greater than the specified value, the light sensing component 130 triggers the audible alertor 140 to issue an audio alarm. This triggering process can refer to the process that the light sensing component 130 triggers the audible alertor 140 in the embodiments described above, which are not repeated here.

As shown in FIG. 2, the well curb device can further include a human body sensor 150. Both the light sensing component 130 and the audible alertor 140 can be connected with the human body sensor 150. The human body sensor 150 can be used to detect whether a human body is close to the well curb 110 within a preset range of the well curb 110. Exemplarily, the preset range can be an area surrounded by a circle with a center of the well cover as a circle center and a predetermined distance as a radius.

Exemplarily, as shown in FIG. 2, the light sensing component 130 is connected with the human body sensor 150. The human body sensor 150 is connected with the audible alertor 140. The light sensing component 130 can be used to trigger the human body sensor 150 to detect whether a human body is close to the well curb 110 within the preset range, when detecting that the light intensity around the well curb 110 is greater than the specified value. The preset range can be set according to performances of different human body sensors 150, which is not limited herein. This detection process of the light sensing component 130 can refer to the process that the light sensing component 130 triggers the audible alertor 140 in the embodiments described above, which is not repeated herein. For example, after detecting that a human body is close to the well curb 110 within the preset range, the human body sensor 150 sends a trigger signal to the audible alertor 140, so as to trigger the audible alertor 140 to issue an audio alarm of a specified decibel. The specified decibel can be greater than or equal to a maximum decibel of sounds within a period of time (e.g., one day) at a position where the well curb device is located. Optionally, a sound sensor for acquiring the maximum decibel can be included in the well cover device. In addition, the specified decibel can also be determined in another manners, so as to ensure that the audio alarm issued by the audible alertor can be perceived by the pedestrian within the preset range, which is not repeated herein.

Optionally, the human body sensor 150 can be an infrared sensor. Since a human body can emit infrared rays, when a human body enters a preset range that can be detected by the infrared sensor, the infrared sensor can detect the infrared rays emitted by the human body. At this time, the infrared sensor can send a trigger signal to the audible alertor 140, so as to trigger the audible alertor 140 to issue an audio alarm. Optionally, the human body sensor 150 can also be a human body sensor based on Doppler technology, which is not limited herein.

Optionally, the human body sensor 150 may also establish a connection with the well cover sensor 120 (the connection relationship is not shown in FIG. 2). That is, the human body sensor 150 can be triggered by the well cover sensor 120. When detecting that the well cover is not placed in the placing portion 111, the well cover sensor 120 sends a trigger signal to the human body sensor 150, so as to trigger the human body sensor 150 to detect whether a human body is close to the well curb 110 within a preset range. When detecting that the human body is close to the well curb 110 within the preset range, the human body sensor 150 sends a trigger signal to the audible alertor 140, so as to trigger the audible alertor 140 to issue an audio alarm of a specified decibel.

By means of the human body sensor 150, the well curb device can trigger the audible alertor 140 to issue an audio alarm when a human body is close to the well curb 110 within the preset range, thereby saving the energy consumption of the well curb device, and making the audio alarm more efficient.

Optionally, as shown in FIG. 2, the well curb device further includes a light alertor 160. The light alertor 160 is connected with the light sensing component 130. The light sensing component 130 can be used to trigger the light alertor 160 to issue a light alarm of a specified brightness value, when detecting that the light intensity around the well curb 110 is not greater than a specified value. This triggering process can refer to the process that the light sensing component 130 triggers the audible alertor 140 in the embodiment described above. Herein, the light alarm of the specified brightness value, which is issued by the light alertor 160, can vary within a specified brightness range according to a brightness value around the well curb 110. When the brightness value around the well curb 110 is low, the light alertor 160 can issue a light alarm of a lower brightness value within the specified brightness range. When the brightness value around the well curb 110 is high, the light alertor 160 can issue a light alarm of a higher brightness value within the specified brightness range.

Exemplarily, the light alertor 160 can be a light-emitting diode (abbreviated as LED) disposed on the well curb 110. A pressure-resistant and transparent housing can be provided outside the LED to protect the LED from damages.

Optionally, when the light intensity around the well curb 110 is not greater than a preset light intensity threshold, the light alertor 160 is triggered to issue a light alarm, and the audible alertor 140 is also triggered to issue an audio alarm at the same time, thereby avoiding a situation that a user falls into a well without a well cover due to not seeing the light alarm. For example, it is easy for a pedestrian, who plays a mobile phone when walking and only focuses on the mobile phone, to ignore the light alarm. At this time, the audio alarm can enable the pedestrian to shift attention from the mobile phone to the well curb device, so that the pedestrian notices the well without the well cover around, thereby avoiding a situation that the pedestrian is injured because of falling into a well without a well cover.

Therefore, when detecting that the light intensity around the well curb 110 is not greater than the specified value, the light sensing component 130 can trigger at least one of the audible alertor 140 and the light alertor 160.

Optionally, the well curb device further includes a liquid level sensing component 170. The liquid level sensing component 170 can be connected with the well cover sensor 120. When detecting that the well cover is not placed in the placing portion 111, the well cover sensor 120 sends a trigger signal to the liquid level sensing component 170, so as to trigger the liquid level sensing component 170.

The liquid level sensing component 170 includes a liquid level sensor and a comparator. The liquid level sensor is a sensor for acquiring a liquid height based on a principle that a liquid pressure is proportional to the liquid height.

The liquid level sensor can acquire a height of the water submerging the well curb device. Since when the well cover is submerged by water of the specified height, it may be difficult to ensure that the audio alarm of the specified decibel issued by the audible alertor 140 and/or the light alarm of the specified brightness issued by the light alertor 160 can be perceived by the pedestrian within the preset range. Therefore, the comparator in the liquid level sensing component 170 can be used to compare the height of the water submerging the well curb device with the specified height. When the height of the water submerging the well curb device is greater than the specified height, the comparator can send a trigger signal to the light alertor 160 and the audible alertor 140. Both the height acquired by the liquid level sensor and the specified height can be electrical signals, and the comparator can determine whether the height acquired by the liquid level sensor is greater than the specified height by comparing the current intensities of the two electrical signals. Herein, the light alertor 160 can include a first signal interface and a second signal interface, and the audible alertor 140 can include a first signal interface and a second signal interface. The light sensing component 130 can be connected with the first signal interface of the light alertor 160 and the first signal interface of the audible alertor 140. When receiving a trigger signal, the first signal interface of the light alertor 160 may issue a light alarm of the specified brightness. When receiving a trigger signal, the first signal interface of the audible alertor 140 may issue an audio alarm of the specified decibel.

The liquid level sensing component 170 can be connected with the first signal interface and the second signal interface of the light alertor 160 simultaneously. The liquid level sensing component 170 can also be connected with the first signal interface and the second signal interface of the audible alertor 140 simultaneously. When detecting that a water level around the well curb 110 is not higher than the specified height, the liquid level sensing component 170 can send a trigger signal to the first signal interface of the light alertor 160 and/or the first signal interface of the audible alertor 140, so as to trigger the light alertor 160 and/or the audible alertor 140 to issue an alarm. When detecting that the water level around the well curb 110 is higher than the specified height, the liquid level sensing component 170 can send a trigger signal to the second signal interface of the light alertor 160 so as to trigger the light alertor 160 to issue a light alarm of a specified high brightness, and send a trigger signal to the second signal interface of the audible alertor 140 so as to trigger audible alertor 140 to issue an audio alarm of a specified high decibel. The specified high brightness is greater than the specified brightness, and the specified high decibel is greater than the specified decibel.

Optionally, the specified high brightness can be a maximum brightness that the light alertor 160 can emit. The specified high decibel can be a maximum decibel that the audible alertor 140 can sound.

Optionally, the liquid level sensing component 170 can be connected with the well cover sensor 120, and can be triggered by the well cover sensor 120 (as shown in FIG. 2). The liquid level sensing component 170 can also be connected with the light sensing component 130, and can be triggered by the light sensing component 130 (not shown in FIG. 2), which is not limited herein.

By means of providing a liquid level sensing component 170, the light alertor 160 can be triggered by the liquid level sensing component 170 to issue a light alarm of a high brightness, and the audible alertor 140 can be triggered by the liquid level sensing component 170 to issue an audio alarm of a high decibel, thereby ensuring that even if the well curb device is submerged by water, it can still alert a pedestrian to pay attention to the walking safety and avoid the pedestrian from falling into a well without a well cover.

Optionally, the well curb device further includes a guard component 180 disposed in the well curb 110. When detecting that the well cover is not placed in the placing portion 111, the well cover sensor 120 can send a trigger signal to the guard component 180, so as to trigger the guard component 180 to form a blocking structure in a space enclosed by the well curb 110. The blocking structure can block an object from passing through the well curb 110. Exemplarily, the blocking structure can prevent a pedestrian or an animal from falling into a well without a well cover.

Figure 3:
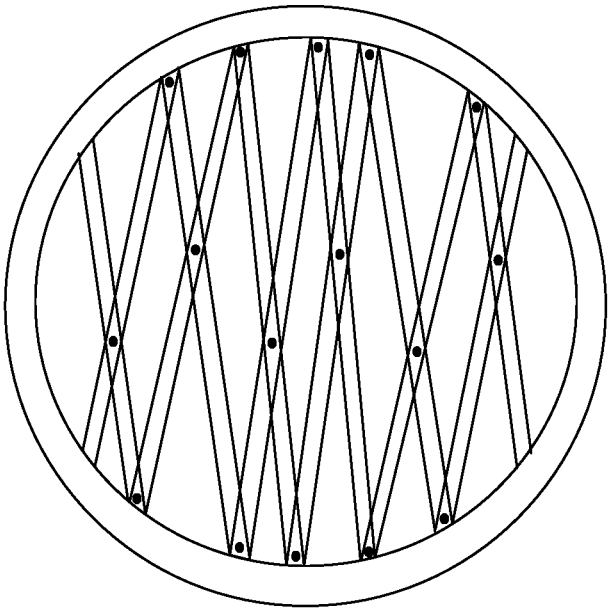
FIG. 3 is a schematic diagram of a structure of a guard component in a well curb device provided in an embodiment of the present disclosure.

Optionally, the guard component 180 can be an expansible fence. As shown in FIG. 3, which is a top view of the well curb device shown in FIG. 2, it is illustrated that the blocking structure is formed on a position of an original well cover (i.e., corresponding to a position of the placing portion), after the expansible fence receives the trigger signal sent by the well cover sensor.

Optionally, referring to the well curb device shown in FIG. 2 again, the well curb device further includes a reset button 190. The well cover sensor 120, the light sensing component 130, the audible alertor 140, the light alertor 160 and the guard component 180 can all be connected with the reset button 190. The reset button 190 is used to control ON/OFF of the well cover sensor 120, the light sensing component 130, the audible alertor 140, the light alertor 160 and the guard component 180.

Exemplarily, when a maintenance person prepares to check or repair a well curb device, the well cover may be removed. As can be seen from the embodiments described above, after the well cover is removed from the placing portion 111, other components may be triggered (e.g., triggering the light sensing component 130 to detect the light intensity around the well curb 110, or triggering the human body sensor 150 to detect whether a human body is close to the well curb 110 within a preset range), but actually, it may not be necessary to trigger other components at this time. Therefore, the maintenance person may make the well cover sensor 120, the light sensing component 130, the audible alertor 140, the light alertor 160 and the guard component 180 in an OFF state by pressing the reset button 190. After the repair is completed, the maintenance person may make the well cover sensor 120, the light sensing component 130, the audible alertor 140, the light alertor 160 and the guard component 180 in an ON state by pressing the reset button 190 again.

Optionally, the well curb device further includes an reminder component 200 disposed in the well curb 110. The reminder component 200 can be connected with the well cover sensor 120. When detecting that the well cover is not placed on the placing portion 111, the well cover sensor 120 triggers the reminder component 200 to send reminder information to a preset device in a wired (e.g., through an optical fiber or a coaxial cable manner) or wireless (e.g., through various mobile networks) manner. The preset device may be a host of a related department that supervises the well curb device. The reminder information can include the position of the well curb 110. The reminder information may enable the relevant department that supervises the well curb device to know that the well cover in the well curb 110 has been lost, so that the relevant department can arrange somebody to repair as soon as possible.

Optionally, the well curb device further includes an energy source component 210. The energy source component 210 can provide electrical energy to the well curb device. Exemplarily, the energy source component 210 can be connected with the well cover sensor 120, the light sensing component 130, the audible alertor 140, the human body sensor 150, the light alertor 160, the liquid level sensing component 170, the guard component 180, the reset button 190 and the reminder component 200 (the connection manner is not shown in FIG. 2). Exemplarily, the energy source component 210 can be a solar cell.

Optionally, the well curb device can further include a control component 220 that can be connected with the well cover sensor 120, the light sensing component 130, the audible alertor 140, the human body sensor 150, the light alertor 160, the liquid level sensing component 170, the guard component 180, the reset button 190, the reminder component 200 and the energy source component 210 (the connection manner is not shown in FIG. 2). The control component 220 can be used to control various components in the well curb device. The control component 220 can be one or more central processing units (abbreviated as CPU), or a control chip or a control circuit.

Optionally, the control component can detect, by the well cover sensor, whether a well cover is placed in the placing portion, and control the light sensing component to detect whether the light intensity around the well curb is greater than a specified value when determining that the well cover is not placed in the placing portion; and control the audible alertor to issue the audio alarm of a specified decibel when determining the light intensity around the well curb detected by the light sensing component is greater than a specified value.

Optionally, the control component can also acquire a pressure value that is applied to the placing portion and collected by the pressure sensor, compare the pressure value with a specified pressure value, and determine that the well cover is not placed in the placing portion when the pressure value is less than the specified pressure value.

In summary, another well curb device provided in the embodiments of the present disclosure triggers an audible alertor to issue an audio alarm, when the light sensing component detects that the light intensity around the well curb is not greater than the specified value.

By means of a human body sensor, the well curb device can trigger the audible alertor to issue an audio alarm, when a human body is close to the well curb within the preset range, thereby saving the energy consumption of the well curb device, and making the audio alarm more efficient.

The well curb device also can trigger at least one of the audible alertor and the light alertor to issue an alarm, when detecting that the light intensity around the well curb is not greater than the specified value. Moreover, when the light intensity around the well curb is not greater than the preset light intensity threshold, the light alertor can be triggered to issue a light alarm, and the audible alertor can also be triggered to issue an audio alarm at the same time, thereby avoiding a situation that a user falls into a well without a well cover due to not seeing the light alarm.

In addition, by disposing a liquid level sensing component in the well curb device, the light alertor can be triggered by the liquid level sensing component to issue a light alarm of a high brightness, and the audible alertor can also be triggered by the liquid level sensing component to issue an audio alarm of a high decibel, thereby ensuring that even if the well curb device is submerged by water, it can still alert a pedestrian to pay attention to the walking safety and avoid the pedestrian from falling into a well without a well cover. When detecting that the well cover is not placed in the placing portion, the well cover sensor can trigger the guard component to form a blocking structure in a space enclosed by the well curb, thereby avoiding a pedestrian or an animal from falling into a well without a well cover.

Figure 4:
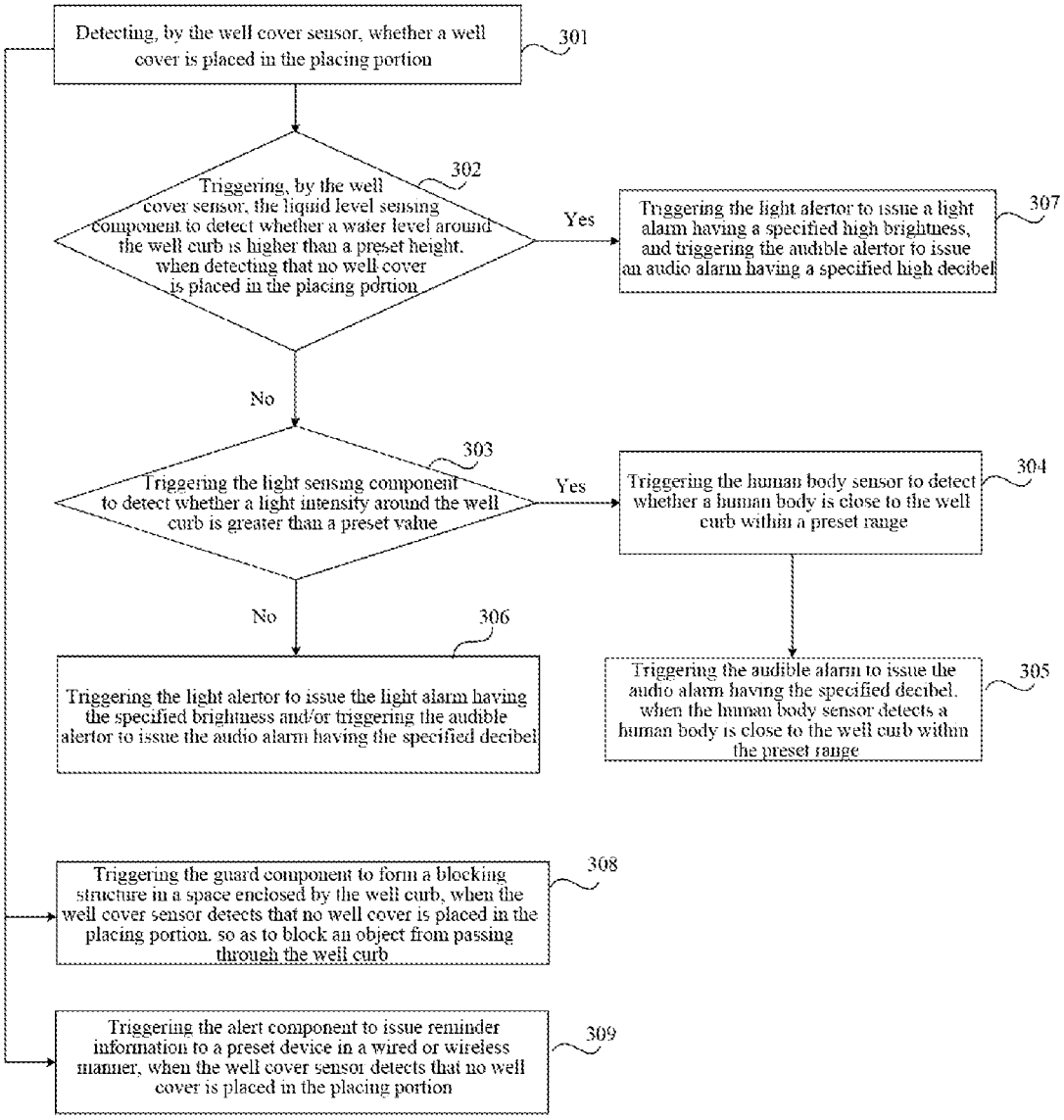
FIG. 4 is a flow chart of a method for controlling a well curb device provided in an embodiment of the present disclosure.

As shown in FIG. 4, there is further provided in an embodiment of the present disclosure a method for controlling a well curb device, so as to control the well curb device shown in FIG. 2, the method includes the following steps.

At step 301, the well cover sensor detects whether a well cover is placed in the placing portion.

The control component in the well curb device can control the well cover sensor to detect whether a well cover is placed in the placing portion. The content of detecting, by the well cover sensor, whether a well cover is placed in the placing portion can refer to the embodiment shown in FIG. 1, which is not repeated herein. Alternatively, after started, the well cover sensor can also automatically detect whether a well cover is placed in the placing portion. Step 302 is executed when the well cover sensor detects that the well cover is not placed in the placing portion.

Optionally, step 308 and/or step 309 can also be executed when the well cover sensor detects that the well cover is not placed in the placing portion. When the well cover sensor detects that there is a well cover in the placing portion, the present step is continued to be executed, so as to continuously detect whether a well cover is placed in the placing portion.

At the step 302, the well cover sensor triggers the liquid level sensing component to detect whether a water level around the well curb is higher than a specified height, when detecting that the well cover is not placed in the placing portion.

The control component can trigger the liquid level sensing component to detect whether the water level around the well curb is higher than the specified height, when the well cover sensor detects that the well cover is not placed in the placing portion. This detection process can refer to the above embodiment shown in FIG. 2, which is not repeated herein.

Step 307 can be executed when the water level around the well curb detected by the liquid level sensing component is higher than the specified height; and step 303 can be executed when the water level around the well curb detected by the liquid level sensing component is not higher than the specified height.

At step 303, the light sensing component is triggered to detect whether a light intensity around the well curb is greater than a specified value.

The control component can trigger the light sensing component to detect whether the light intensity around the well curb is greater than the specified value, when the liquid level sensing component detects that the water level around the well curb is not higher than the specified height. This detection process can refer to the embodiment shown in FIG. 1, which is not repeated herein.

Step 304 can be executed when the light intensity around the well curb detected by the light sensing component is greater than the specified value; and step 306 can be executed when the light intensity around the well curb detected by the light sensing component is not greater than the specified value.

At step 304, the human body sensor is triggered to detect whether a human body is close to the well curb within a preset range.

The control component can trigger the human body sensor to detect whether a human body is close to the well curb within the preset range, when the light sensing component detects that the light intensity around the well curb is greater than the specified value. This detection process can refer to the embodiments shown in FIG. 2, which is not repeated herein.

Step 305 can be executed when the human body sensor detects that a human body is close to the well curb within the preset range; and the step 301 can be executed when the human body sensor detects that the human body is not close to the well curb within the preset range.

At the step 305, the audible alertor is triggered to issue the audio alarm of the specified decibel, when the human body sensor detects a human body is close to the well curb within the preset range.

The control component can trigger the audible alertor to issue the audio alarm of the specified decibel, when the human body sensor detects that a human body is close to the well curb within the preset range. The content concerning the audio alarm of the specified decibel can refer to the embodiment shown in FIG. 2, which is not repeated herein.

Optionally, when the human body sensor detects that a human body is close to the well curb within the preset range, the light alertor can also be triggered to issue the light alarm of the specified brightness.

At step 306, the light alertor is triggered to issue the light alarm of the specified brightness and/or the audible alertor is triggered to issue the audio alarm of the specified decibel.

The control component can trigger the light alertor to issue the light alarm of the specified brightness and/or trigger the audible alertor to issue the audio alarm of the specified decibel, when the light sensing component detects that the light intensity around the well curb is not greater than the specified value. Alternatively, the human body sensor may also trigger the light alertor to issue the light alarm of the specified brightness and/or trigger the audible alertor to issue the audio alarm of the specified decibel. The content concerning the light alarm of the specified brightness and the audio alarm of the specified decibel can refer to the embodiment shown in FIG. 2, which is not repeated herein.

Optionally, when this step is executed, after the light sensing component detects that the light intensity around the well curb is not greater than the specified value, the human body sensor can first be triggered to detect whether a human body is close to the well curb within the preset range. When the human body sensor detects that a human body is close to the well curb within the preset range, the light alertor can be triggered to issue the light alarm of the specified brightness and/or the audible alertor can be triggered to issue the audio alarm of the specified decibel.

At step 307, the light alertor is triggered to issue a light alarm of a specified high brightness, and the audible alertor is triggered to issue an audio alarm of a specified high decibel.

The control component can trigger the light alertor to issue the light alarm of the specified high brightness, and trigger the audible alertor to issue the audio alarm of the specified high decibel, when the liquid level sensing component detects that the water level around the well curb is higher than the specified height. Alternatively, the human body sensor can also the light alertor to issue the light alarm of the specified high brightness and/or trigger the audible alertor to issue the audio alarm of the specified high decibel.

Herein, the specified high brightness is greater than the specified brightness, and the specified high decibel is greater than the specified decibel. The content concerning the audio alarm of the specified high decibel and the light alarm of the specified high brightness can refer to the embodiment shown in FIG. 2, which is not repeated herein.

At step 308, the guard component is trigger to form a blocking structure in a space enclosed by the well curb, when the well cover sensor detects that the well cover is not placed in the placing portion, so as to block an object from passing through the well curb.

The control component can trigger the guard component to form the blocking structure in the space enclosed by the well curb, when the well cover sensor detects that the well cover is not placed in the placing portion, so as to block the object from passing through the well curb. The blocking structure can be the blocking structure 180 in the well curb device shown in FIG. 2. Alternatively, the well cover sensor can also trigger the guard component to form the blocking structure in the space enclosed by the well curb, when detecting that the well cover is not placed in the placing portion.

At step 309, the reminder component is triggered to issue reminder information to a preset device in a wired or wireless manner, when the well cover sensor detects that the well cover is not placed in the placing portion.

The control component can trigger the reminder component to issue reminder information to the preset device in the wired or wireless manner, when the well cover sensor detects that the well cover is not placed in the placing portion. The manner of sending the reminder information can refer to the embodiment shown in FIG. 2, which is not repeated herein. Alternatively, the well cover sensor can also trigger the reminder component to issue the reminder information to the preset device in the wired or wireless manner.

The contents described in above embodiments can be one of control methods of a well curb device, which can be adjusted according to the situation during the process of using the well curb device. For example, all of the above steps may be performed, or some of the above steps may be performed, or the control method can be performed in other orders. Exemplarily, the step 308 and the step 309 can be executed after the step 302, and can also be executed after the step 305. For another example, in the step 302, when the well cover sensor detects that the well cover is not placed in the placing portion, instead of triggering the liquid level sensing component to detect whether the water level around the well curb is higher than the specified height, the step of triggering the light sensing component to detect whether the light intensity around the well curb is greater than the specified value in the step 303 is performed, which is not limited herein.

In summary, a method for controlling a well curb device provided in the embodiments of the present disclosure can trigger an audible alertor to issue an audio alarm of a specified decibel, when the well cover is not placed in the placing portion and the light intensity around the well curb is greater than a specified value, that is, in the case of bright light, the well curb device can still alert a pedestrian through an audible alertor, so as to prevent the pedestrian from falling into a well without a well cover, thereby solving the problem of lower safety of the well curb device in the related art, and achieving the effect of improving the safety of the well curb device.

In addition, there is further provided in an embodiment of the present disclosure a computer storage medium storing instructions therein. When the computer storage medium is running on a well curb device, the well curb device performs a method for controlling a well curb device. The well curb device includes: a well curb, a well cover sensor, a light sensing component and an audible alertor. The well cover sensor, the light sensing component and the audible alertor are sequentially connected. The well curb includes a placing portion for placing a well cover. The well cover sensor is disposed on the well curb.

The method includes the steps of:

detecting, by the well cover sensor, whether a well cover is placed in the placing portion;

when the well cover is not placed in the placing portion, detecting, by the light sensing component, whether the light intensity around the well curb is greater than a specified value; and when the light intensity around the well curb is greater than the specified value, issuing, by the audible alertor, an audio alarm of a specified decibel.

The term "and/or" in the present disclosure only indicates an association relationship describing associated objects, and represents that three relationships may exist. For example, A and/or B can represent three cases, i.e., A exists individually, A and B exist simultaneously, and B exists individually. In addition, the character "/" herein typically represents a relationship of "or" between anteroposterior associated objects.

The term "at least one of A and B" in the present disclosure only indicates an association relationship describing association objects, and represents that three cases may exist. For example, at least one of A and B can represent three cases, i.e., A exists individually, A and B exist simultaneously, and B exists individually.

Those skilled in the art understand that the steps in the above embodiments can be implemented partly or totally in hardware, or implemented in the relevant hardware instructed by a program. The program can be stored in a computer readable storage medium. The storage medium can be a read only memory (ROM), a magnetic disk, a CD or the like.

The above are only exemplary embodiments of the present disclosure and are not intended to limit the present disclosure. Any modification, equivalent substitution and improvement without departing from the spirit and principle of the present disclosure shall fall into the protection scope of the present disclosure.

What is claimed is:

1. A well curb device, comprising: a well curb, a well cover sensor, a light sensing component and an audible alertor, wherein the well cover sensor, the light sensing component and the audible alertor are sequentially connected, the well curb comprises a placing portion for placing a well cover;

the well cover sensor is disposed on the well curb, and is configured to detect whether the well cover is placed in the placing portion;

the well cover sensor is configured to trigger the light sensing component to detect whether a light intensity around the well curb is greater than a specified value, when detecting that the well cover is not placed in the placing portion; and the light sensing component is configured to trigger the audible alertor to issue an audio alarm of a specified decibel, when detecting that the light intensity around the well curb is greater than the specified value.

2. The well curb device according to claim 1, further comprising a reminder component disposed in the well curb, wherein the well cover sensor is configured to trigger the reminder component to send reminder information to a specified device in a wired or wireless manner, when detecting that the well cover is not placed in the placing portion.

3. The well curb device according to claim 1, further comprising an energy source component connected with all of the well cover sensor, the light sensing component and the audible alertor.

4. The well curb device according to claim 1, further comprising: a light alertor connected with the light sensing component, wherein the light sensing component is configured to trigger the light alertor to issue a light alarm of a specified brightness, when detecting that the light intensity around the well cover is not greater than the specified value.

5. The well curb device according to claim 4, wherein the specified brightness is positively correlated with the light intensity around the well cover.

6. The well curb device according to claim 4, wherein the light sensing component is configured to trigger the audible alertor to issue an audio alarm, when detecting that the light intensity around the well cover is not greater than the specified value.

7. The well curb device according to claim 4, further comprising: a liquid level sensing component connected with the light alertor and the audible alertor, wherein the liquid level sensing component is configured to detect whether a water level around the well curb is higher than a specified height; and the liquid level sensing component is configured to trigger the light alertor to issue a light alarm of a specified high brightness, and trigger the audible alertor to issue an audio alarm of a specified high decibel, when the water level around the well curb is higher than the specified height; the specified high brightness is greater than the specified brightness, and the specified high decibel is greater than the specified decibel.

8. The well curb device according to claim 7, wherein the liquid level sensing component comprises: a liquid level sensor and a comparator, the liquid level sensor is configured to acquire a height of water submerging the well curb device; and the comparator is configured to compare the height with the specified height, and determine that the water level around the well curb is higher than the specified height, when the height is higher than the specified height.

9. The well curb device according to claim 4, further comprising a guard component disposed in the well curb, wherein the well cover sensor triggers the guard component to form a blocking structure in a space enclosed by the well curb, when detecting that the well covert is not placed in the placing portion, so as to block an object from passing through the well curb.

10. The well curb device according to claim 9, further comprising a reset button connected with all of the well cover sensor, the light sensing component, the audible alertor, the light alertor and the guard component, wherein the reset button is configured to control ON/OFF of the well cover sensor, the light sensing component, the audible alertor, the light alertor and the guard component.

11. The well curb device according to claim 9, wherein the guard component comprises an expansible fence.

12. The well curb device according to claim 1, wherein the well cover sensor comprises a pressure sensor.

13. The well curb device according to claim 12, wherein the well cover sensor further comprises a comparator, the pressure sensor is configured to acquire a pressure value applied to the placing portion; and the comparator is configured to compare the pressure value with a specified pressure value, and determine that the well cover is not placed in the placing portion when the pressure value is less than the specified pressure value.

14. The well curb device according to claim 1, further comprising a human body sensor connected with both the light sensing component and the audible alertor, wherein the human body sensor is configured to detect whether a human body is close to the well curb within a specified range of the well curb, the light sensing component is configured to trigger the human body sensor to detect whether a human body is close to the well curb within the specified range, when detecting that the light intensity around the well curb is greater than the specified value; and the human body sensor is configured to trigger the audible alertor to issue an audio alarm of the specified decibel, when detecting that a human body is close to the well curb within the specified range.

15. The well curb device according to claim 14, wherein the human body sensor is an infrared sensor.

16. A control method for controlling the well curb device which comprises: a well curb, a well cover sensor, a light sensing component and an audible alertor, the well cover sensor, the light sensing component and the audible alertor being sequentially connected, the well curb comprising a placing portion for placing a well cover, and the well cover sensor being disposed on the well curb, comprising the steps of:

detecting, by the well cover sensor, whether a well cover is placed in the placing portion;

detecting, by the light sensing component, whether the light intensity around the well curb is greater than a specified value, when the well cover is not placed in the placing portion; and issuing, by the audible alertor, an audio alarm of a specified decibel, when the light intensity around the well curb is greater than the specified value.

17. The method according to claim 16, wherein the well curb device further comprises a guard component disposed in the well curb, and the method further comprises the step of:

triggering, by the well cover sensor, the guard component to form a blocking structure in a space enclosed by the well curb, when detecting that the well cover is not placed in the placing portion, so as to block an object from passing through the well curb.

18. The method according to claim 16, wherein the well curb device further comprises a light alertor connected with the light sensing component, and the method further comprises the step of:

triggering, by the light sensor, the light alertor to issue a light alarm of a specified brightness, when detecting that the light intensity around the well cover is not greater than the specified value.

19. The method according to claim 18, wherein the well curb device further comprises a liquid level sensing component connected with the light alertor and the audible alertor, and the method further comprises the steps of:

detecting, by the liquid level sensing component, whether a water level around the well curb is higher than a specified height; and triggering, by the liquid level sensor, the light alertor to issue a light alarm of a specified high brightness, and trigger the audible alertor to issue an audio alarm of a specified high decibel, when the water level around the well curb is higher than the specified height; and the specified high brightness is greater than the specified brightness, and the specified high decibel is greater than the specified decibel.

20. A computer storage medium storing instructions, wherein, when the computer storage medium is running on a well curb device, the well curb device performs a method for controlling a well curb device, the well curb device comprises: a well curb, a well cover sensor, a light sensing component and an audible alertor; the well cover sensor, the light sensing component and the audible alertor are sequentially connected, the well curb comprises a placing portion for placing a well cover; and the well cover sensor is disposed on the well curb, and the method comprises the steps of:

detecting, by the well cover sensor, whether a well cover is placed in the placing portion;

detecting, by the light sensing component, whether a light intensity around the well curb is greater than a specified value, when the well cover is not placed in the placing portion; and issuing, by the audible alertor, an audio alarm of a specified decibel, when the light intensity around the well curb is greater than the specified value.

* * * * *